US005653184A

United States Patent [19]

Bardsley

[11] Patent Number: 5,653,184

[45] Date of Patent: Aug. 5, 1997

[54] WATER COOLED TUFTING MACHINE

[75] Inventor: Harold Brian Bardsley, Lancashire, England

[73] Assignee: Spencer Wright Industries, Inc., Dalton, Ga.

[21] Appl. No.: 578,735

[22] Filed: Dec. 26, 1995

[51] Int. Cl.[6] ..... D05B 71/00; D05C 15/04

[52] U.S. Cl. ..... 112/80.01; 112/280

[58] Field of Search ..... 112/281, 80.01, 112/280; 62/331

[56] References Cited

U.S. PATENT DOCUMENTS

| | | | |
|---|---|---|---|
| 3,382,681 | 5/1968 | Hagy | 112/281 X |
| 4,285,293 | 8/1981 | Martling | 112/281 |
| 4,480,565 | 11/1984 | Harbst et al. | 112/281 |

*Primary Examiner*—Paul C. Lewis
*Attorney, Agent, or Firm*—Alan Ruderman

[57] ABSTRACT

An individual controlled needle tufting machine has a reciprocating latch bar for latching and unlatching to selective needle carriers, each needle carrier being guided in a respective guide formed in a guide block and carrying a respective needle so that each needle selectively may be driven by the latch bar. The tufting machine has mechanism for laterally shifting the latch bar and needle carriers, whether latched or unlatched to the latch bar, together with guide blocks. The latch bar and the brackets to which the guide blocks are mounted are formed from aluminum alloy to which laterally extending tubes are fastened. Water, cooled by refrigeration, is circulated through the tubes so that the thermal expansion of the aluminum alloy elements are not substantially greater than the remainder of the tufting machine.

11 Claims, 4 Drawing Sheets

WATER COOLED TUFTING MACHINE

BACKGROUND OF THE INVENTION

This invention relates to tufting machines and more particularly to a tufting machine wherein certain of the moving elements in the head of the machine are cooled by water.

Tufting machines which produce carpet, basically include a large frame having a head within which a rotatable mainshaft is mounted and from which needle driving structure is supported for reciprocating a multiplicity of needles. The frame also includes a bed within which oscillating loopers or hooks are mounted for cooperating with the needles to form loops of yarn, knives being used in conjunction with the hooks to cut the loops in many tufting machines. As the tufting art has developed, there have been a substantial number of innovations to obtain unique patterning effects. One such innovation has been to shift the needles laterally in accordance with a pattern. Another innovation has been to provide each needle with a sew/no-sew capability by mounting the needles on individual needle carriers which are reciprocated selectively by either being latched to or disengaged from a reciprocating latch bar, the latter being reciprocably driven continuously from mechanism driven by the rotating mainshaft. When latched to the latch bar, the needle reciprocates into cooperation with the hook to form a loop. The latching occurs by means of latch pins on pneumatic cylinders driven in accordance with a pattern. Machines of this type are known as controlled needle machines, and when each needle is individually controlled in this manner, it is known as an individual controlled needle machine.

A recent development in the tufting art is to combine the individual control needle machine concept with the shifting needle concept, and to feed the backing material intermittently. This provides a tufting machine wherein the needles may be threaded with a number of different yarns, e.g., yarns of different colors, and a needle having a yarn of a particular color may be inserted into the backing at any of a selected number of locations so that extremely precise multi-color patterns may be produced similar to the fine woven carpets produced by looms.

Tufting machines generally have been constructed from steel. However, as machine speeds have increased, lighter weight structural materials such as aluminum have been considered for the moving parts. The needles, however, because of the frictional forces resulting from penetration of the backing and contacting of the hooks during loop formation are required to be constructed from the stronger harder steel. Other structure and parts additionally should be constructed from steel. When lighter weight materials have been used in conjunction with steel major problems have occurred due to the different thermal expansion rates of these different materials. Thus, when using an aluminum reciprocating needle bar the aluminum expands a substantially greater amount than the remaining materials and the needles have tended to go off gauge, i.e., the needles may not properly cooperate with the hooks. When there is a shiftable needle bar driven from one end of the machine such that the needle bar cannot expand at that one end, all the expansion occurs in one direction and the needles at the other end may be off gauge. Still, it is highly desirable to reduce the mass of the reciprocating elements and the shiftable elements such as the needle bar so that higher speeds may be attainable.

SUMMARY OF THE INVENTION

Consequently, it is a primary object of the present invention to provide a tufting machine having a high degree of cooling to reduce or preclude problems resulting from differential expansion rates when the machine is constructed from different materials.

It is another object of the present invention to provide a tufting machine having a portion of the moving elements constructed from light weight materials which are cooled by water.

It is a further object of the present invention to provide a tufting machine having a needle bar constructed from a lighter weight material than steel and carrying conventional needles constructed from steel, the needle bar being cooled so as to limit thermal expansion.

It is a still further object of the present invention to provide a tufting machine of the controlled needle type having a latch bar including means for selectively latching and unlatching from a plurality of needle carriers to selectively reciprocate each needle carrier and the respective needle, the needles and needle carriers being constructed from steel and the latch bar being constructed from a metal which is lighter in weight than steel.

It is a yet still further object of the present invention to provide a tufting machine of the controlled needle type having a latch bar including means for selectively latching and unlatching from a plurality of needle carriers to selectively reciprocate each needle carrier and the respective needle, the latch bar being reciprocably and slidably mounted on a slideway carried by a reciprocating drive member, the needles, needle carriers, slideway and reciprocating drive members being constructed from steel and the latch bar being constructed from a metal which is lighter in weight than steel.

Accordingly, the present invention provides a tufting machine having a plurality of needles mounted in the head and reciprocally driven into and out of operative relationship with cooperating loopers or hooks mounted in the bed, the needles and certain of the structure for reciprocably driving the needles being constructed from steel while the remainder of the needle driving system is constructed from lighter weight material cooled by circulating water so as to limit or preclude differential thermal expansion resulting from the frictional heat generated during the reciprocation, thereby substantially eliminating the needles from going off gauge with the loopers or hooks while permitting reduction in the mass of the reciprocating structure and thus permitting higher operating speeds.

The invention may be applied to a tufting machine of the type wherein only selective needles may be reciprocably driven during a reciprocation cycle and thus the needles are carried by respective needle carriers, the needle carriers being latched or unlatched selectively to a reciprocating latch bar connected to a reciprocating push rod foot or block, and the latch bar being formed from a light weight material cooled by water. Furthermore, the tufting machine may include means for shifting the latch bar laterally and also for shifting the needle carriers and needles laterally even those not latched to the latch bar during a reciprocating cycle, and the needle guides which laterally support the needles and thus shift laterally with the needles may be carried by water cooled brackets which thus may also be formed from a light weight material thereby reducing the mass of the structure shifted laterally.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
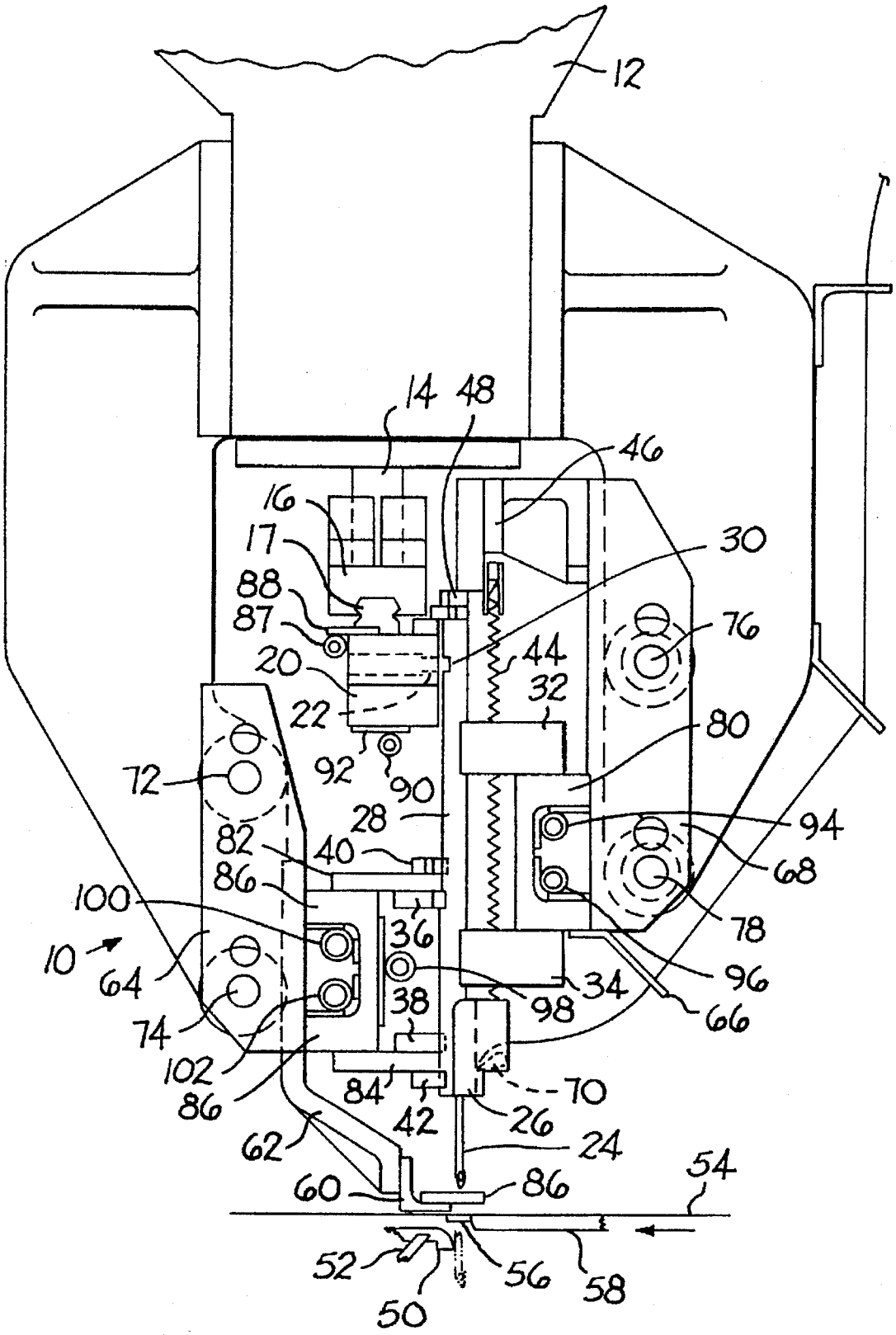
FIG. 1 is a fragmentary side elevational view of a tufting machine incorporating a cooling system constructed in accordance with the principles of the present invention.
Figure 2:
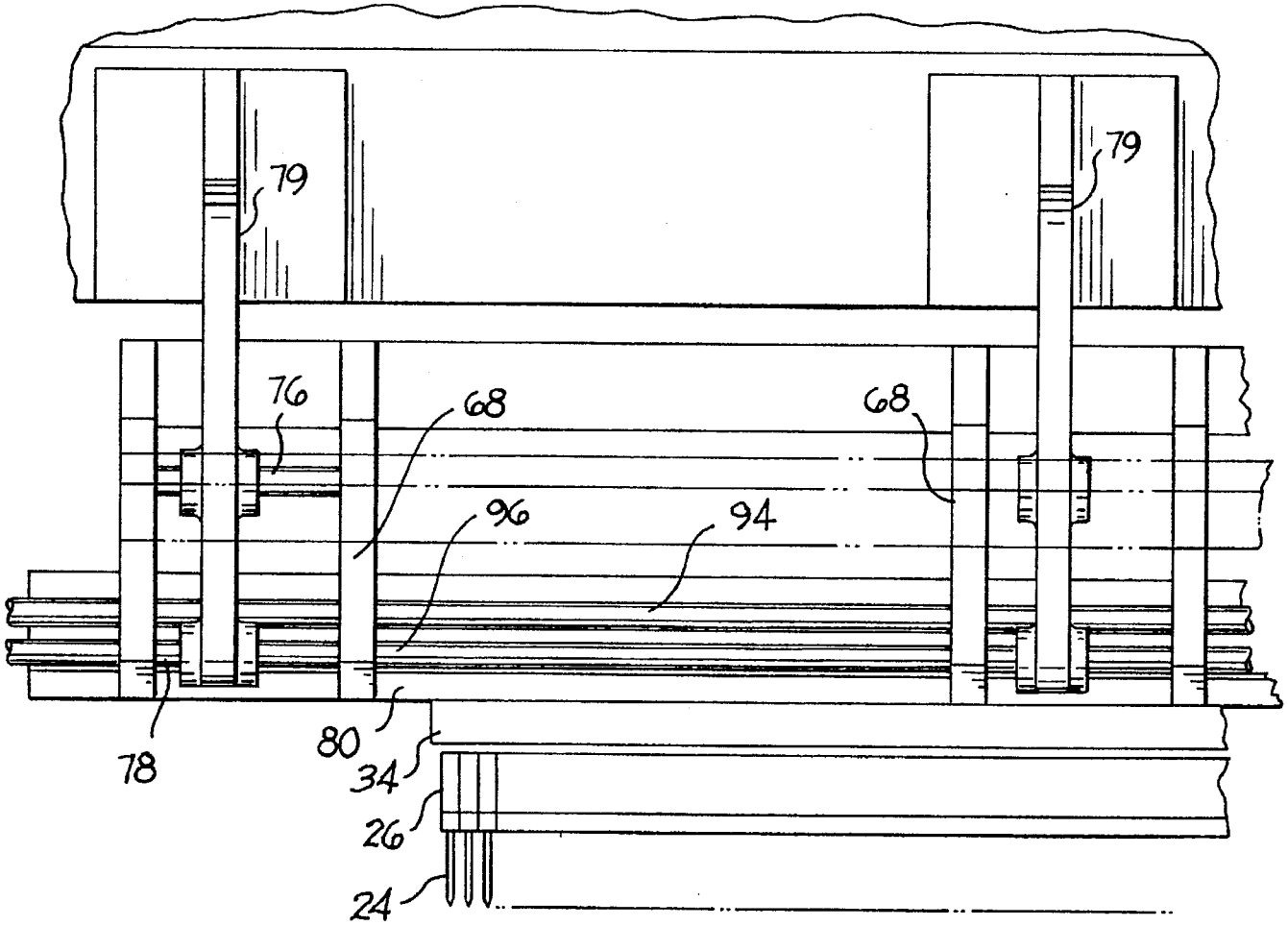
FIG. 2 is a fragmentary front elevational view of the tufting machine illustrated in FIG. 1.

Referring to the drawings, FIG. 1 illustrates a tufting machine 10 incorporating apparatus constructed in accordance with the principles of the present invention. The machine includes a laterally elongated head 12 within which a plurality of laterally spaced push rods 14 are mounted for reciprocation, only one of the push rods being illustrated. The push rods may be reciprocably driven by drive mechanism substantially identical to that disclosed in U.S. Pat. No. 4,860,674. Clamped about the push rods 14 for reciprocation therewith is a laterally elongated push rod foot or block 16. Depending upon the lateral length of the tufting machine and the number of push rods, there may be a number of such push rod feet across the machine reciprocating in synchronism.

The lower end of each push rod includes a linear bearing which has a dove-tail bearing slideway member 17 within which a slidable connecting member 18 journally is positioned for lateral movement, the connecting member 18 being connected by threads or the like to a latch bar 20. The latch bar 20, which thus reciprocates with the push rods 14, has a multiplicity of air cylinders with cylinder actuated latch pins 22 that may be selectively extended from or retracted into the latch bar in accordance with a pattern as illustrated in Bardsley U.S. Pat. No. 4,790,252 in a manner well known in the art. Such a tufting machine is generally known in the art as a controlled needle tufting machine and the disclosed machine additionally has a laterally shiftable latch bar and needles.

Preferably the controlled needle tufting machine incorporates a separately controlled latch pin 22 corresponding to each tufting needle 24 in the machine, and thus is known as an individually controlled needle tufting machine. Thus, each needle 24 is mounted within and extends from a separate needle holder or mounting bar 26 secured to the lower or distal end of a needle carrier 28, the needle carrier 28 being in the form of a thin vertically elongated bar. Adjacent the upper end of the needle carrier is a slot 30 adapted to receive the corresponding latch pin 22. When the latch pin is extended into the slot 30 of the needle carrier 28 associated with a particular needle 24, the needle carrier and thus the needle is reciprocably driven with the latch bar 20 and the push rods 14.

Each needle carrier 28 is guided within respective guide channels in guide blocks 32, 34 and 36, 38, 40, 42 respectively at the front and rear edges of the needle carrier 28 so that the carrier may reciprocate readily in the guide channels. When a latch pin 22 is retracted out of the slot 30 into the latch bar 20, the needle carrier 28 and thus the needle 24 associated with that latch pin is no longer driven; it is rendered inactive. A coil spring 44 having its upper end attached to a frame member 46 extends through the guide blocks 32, 34 and is attached to the top of the needle mounting bar 26. When the latch pin 22 is not engaged in the slot in the respective needle carrier, the spring 44 urges the mounting bar 26, and thus the needle 24 and carrier upwardly toward the head 12, the upper end of the needle carrier being held against an abutment member 48 on a frame member 46 adjacent the upper end of the spring.

Mounted in the bed of the tufting machine is a hook 50 conventionally oscillated into and out of cooperation with the needle 24 to seize and hold loops of yarn when the needle is reciprocated or active, the hook having its free end pointing in the direction opposite to that in which a backing material 54 is fed. An oscillating knife 52 is fed by feed rollers (not illustrated) in the direction of the arrow over a plurality or comb of laterally spaced apart needle plate fingers 56 carried by a bed plate 58 so that when the needle reciprocates, the loops which are seized by the hook project from the face of the backing material and backstitches are formed on the backside or upper surface of the backing material. A presser foot 60 is mounted on a bracket 62 carried by a frame member 64 for engaging the upper or backstitch surface of the backing material to prevent the backing from following the needles so the needles may reciprocate upwardly out of the backing as is well known in the art. Additionally, yarn Y is fed through yarn guides, at least one of the guides 66 being secured to a frame 68 to which the frame member 46 is also secured. A spring biased yarn clamp member 70 pivotably mounted on the mounting bar 26 clamps the yarn, and as the needle moves downwardly pulls yarn from a yarn source such as a creel (not illustrated) so that yarn is available for the subsequent stitch. On the return stroke of the needle, the clamp 70 rides over the yarn as the loop of yarn formed is tightened about the hook 50.

The individually controlled needle tufting machine 10 illustrated in the drawings has the features of shifting the needles 24 laterally so that unique patterns may be produced when such feature is combined with an intermittent backing feed system and yarn of different color or the like are fed to the individual needles. Thus latch bar 20 may be shifted laterally by conventional shifting mechanisms such as that disclosed in Bardsley U.S. Pat. No. 4,662,291 and Ingram U.S. Pat. No. 4,465,501. Additionally, the frame members 64 and 68 are secured to linear bearing slides 72, 74 and 76, 78 respectively supported in slideways within brackets 77, 79 fixed to the frame of the tufting machine so that the presser foot 60 and the guide blocks 36, 38, 40, 42 may be shifted laterally as are the guide blocks 32, 34, frame member 46, the yarn guide 66, and the needle mounting bar 26 and carrier 28, even when not latched to the latch bar 20, when the frame members 64, 48 are jogged laterally as disclosed in the aforesaid Bardsley and Ingram patents.

In order to reduce the mass of the reciprocating and laterally shifting elements, the latch bar 20 has been constructed from a conventional aluminum alloy having good strength and machining properties with a relatively low weight compared to steel. The needle carriers 28 together with the needle mounting bars 26 and the needles are constructed from steel, as is the push rod 14, their driving members, the push rod foot 16 and the linear bearing comprising the slideway member 17 and the connecting member 18. Thus, normally, since the expansion rate of the aluminum alloy is substantially greater than that of steel, misalignment problems between the latch pin 22 carried by the latch bar and the slots 30 of the respective needle carriers may occur. Moreover, since the latch bar 20 in the preferred embodiment is laterally shiftable, so too are the frame members 64 and 68 and the needle carriers 28, and also the guides 32, 34 and 36, 40 and 38, 42.

In order to reduce the mass of the laterally shifting elements, the guides 32, 34 are constructed from nylon while the guides 36, 40 and 38, 42 are constructed from aluminum alloy. The channel shaped bracket 80 which supports the guide blocks 32, 34 from the frame member 68 and the brackets 82, 84 to which the respective guides 36, 40 and 38, 42 are secured, and the channel shaped bracket 86 connecting the brackets 82, 84 to the frame member 64 together with these frame members are all constructed from aluminum alloy, and therefore the differential expansion of these elements relative to the steel members could normally result in certain misalignment problems. All of the above factors may be cumulative when the shifting mechanism drives the laterally shiftable members from one end of the tufting machine because all of the cumulative expansion occurs at the opposite end. This, of course, may result in the needles at that opposite end being off-gauge with the hooks that cooperate therewith.

To solve these problems, the present invention cools at least the aluminum alloy portions of the machine so that the expansion of the aluminum elements are the same or substantially the same as that of the steel elements. To this end, cooled water is circulated through tubing connected to the latch bar 20 and to the brackets 80, 86. Thus, as illustrated in the drawings, a first elongated tube 87 extends along the rear of the latch bar 20, the tube being conventional water carrying tubing constructed from copper and is soldered to or otherwise attached to an elongated plate 88 also constructed from copper and fastened to the latch bar 20 by screws or the like. Similarly, another tube 90 is attached to a plate 92 which is in turned fastened to the bottom of the latch bar 20 so that the tube 90 extends along the bottom of the latch bar. Similar tubing 94, 96 are attached to respective plates fastened within the channel to the bracket 80 which supports the guides 32, 34 at the front of the needle carrier 28 while similar tubing attached to respective plates are fastened to the bracket 86 which supports the guides 36, 40 and 38, 42 at the rear of the needle carrier, there preferably being one such tube 98 at the front surface of the bracket 86 and two tubes 100, 102 in the channel at opposite dispositions at the rear of the bracket 86.

Figure 3:
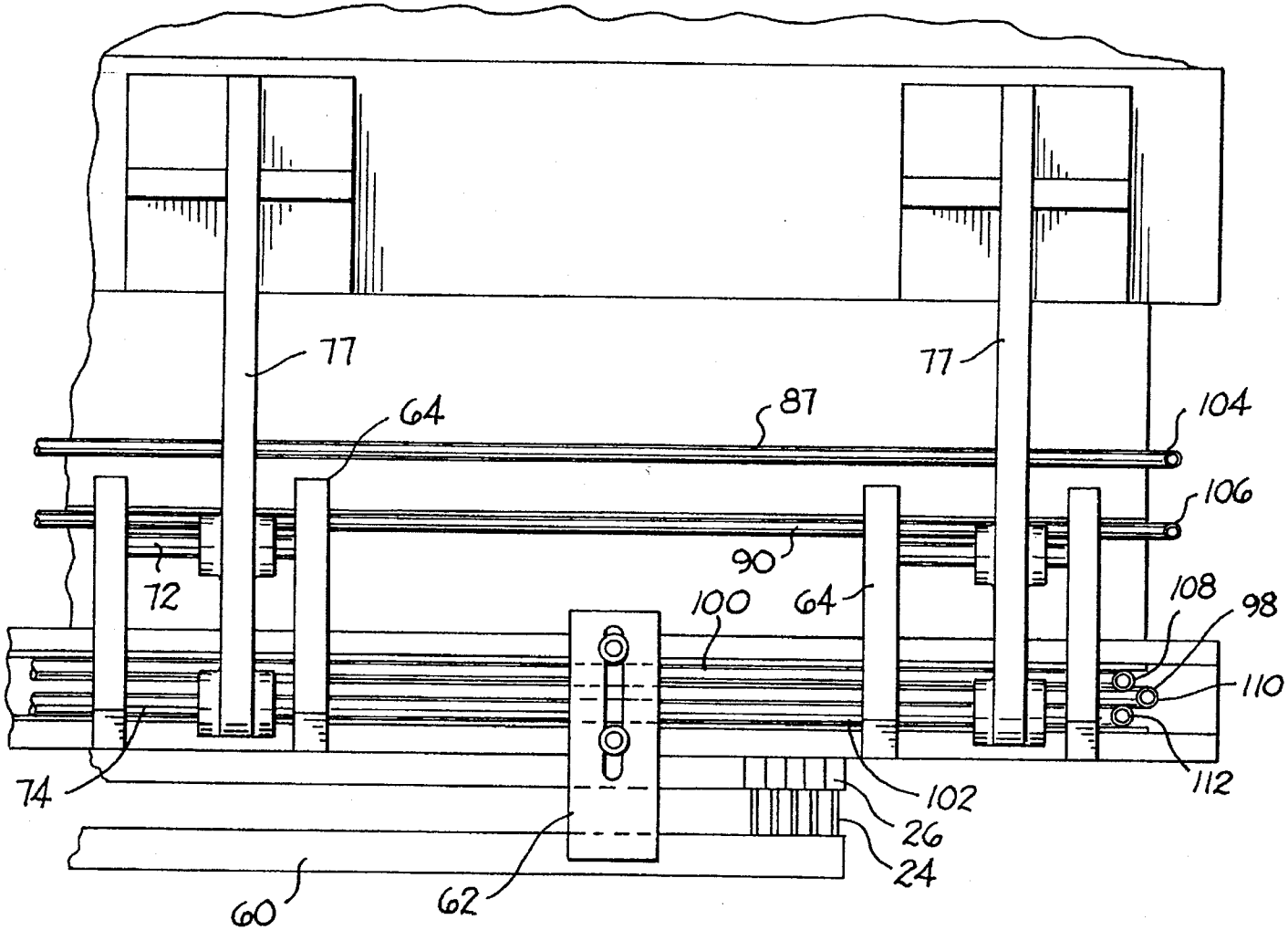
FIG. 3 is a fragmentary rear elevational view of the tufting machine.
Figure 4:
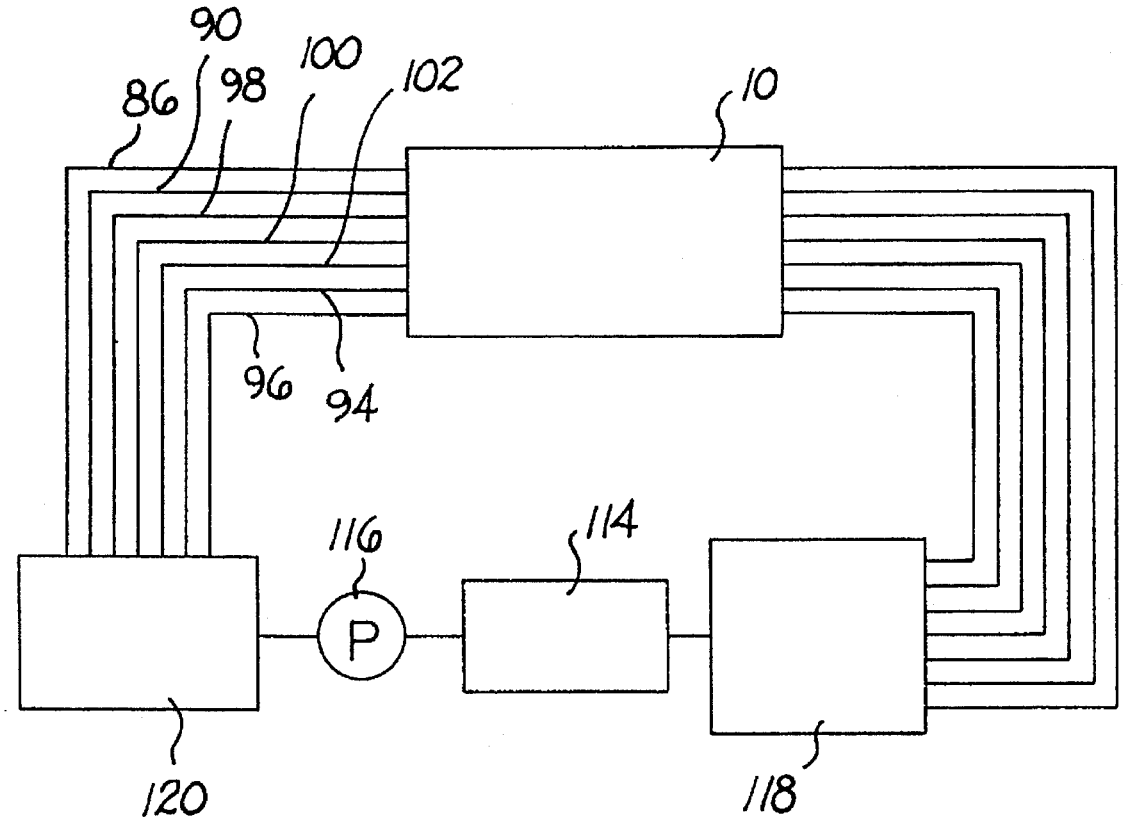
FIG. 4 is a schematic view of a water cooling and circulating arrangement used in the tufting machine of the present invention.

Each of the tubes has couplings forming an inlet at one end of the machine and an outlet at the other end. FIG. 3 illustrates five such couplings 104, 106, 108, 110, 112 forming inlets or outlets for the respective tubes 87, 90, 100, 98, 102 at one end at the rear of the machine. Obviously similar couplings are at the opposite end and also connected to the tubes at the front of the machine. Chilled water from a conventional refrigerated source, such as a refrigeration unit 114 continuously is pumped by a pump 116 through the tubes and recirculated so that the tubes always have cool water flowing therethrough. The water may enter and exit the tubes through respective headers or plenums 118, 120. The water thus continuously removes heat from the members to which the tubes are fastened and thus also from adjacent attached parts. Such cooling of the aluminum alloy parts ensures that thermal expansion of these parts is not greater than the steel parts, thereby overcoming the aforesaid problems. This permits the tufting machine to operate at greater speeds than would otherwise be the case and allows for greater productivity.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufting machine comprising a vertically reciprocating laterally extending needle drive bar, a laterally extending plurality of needles, means for connecting said needles to said bar for reciprocating said needles with said bar, said needles comprising a ferrous metal material and said bar comprising a metal having a weight lighter than ferrous metal and a thermal expansion rate greater than ferrous metal, laterally extending hollow tubing fastened to said bar, and means for circulating cooling water through said tubing.

2. A tufting machine as recited in claim 1, wherein said bar and said needles may be selectively shifted laterally, bracket means movable laterally with said needles while permitting said needles to be reciprocated vertically, laterally extending hollow tubing fastened to said bracket means, and means for circulating cooling water through the tubing fastened to said bracket means.

3. A tufting machine as recited in claim 1, wherein said bar comprises a latch bar having a plurality of latch members, there being one latch member corresponding to each needle, said means for connecting said needles to said bar comprising a needle carrier corresponding to each needle, each needle carrier having a latch receiving slot for receiving a corresponding latch member from said latch bar to couple said carrier to said latch bar so as to move with said latch bar when said latch is received in said slot, and means for connecting a respective needle to each needle carrier.

4. A tufting machine as recited in claim 1, wherein said means for circulating cooling water through said tubing includes refrigeration means.

5. A tufting machine as recited in claim 2, wherein said bar comprises a latch bar having a plurality of latch members, there being one latch member corresponding to each needle, said means for connecting said needles to said bar comprising a needle carrier corresponding to each needle, each needle carrier having a latch receiving slot for receiving a corresponding latch member from said latch bar to couple said carrier to said latch bar so as to move with said latch bar when said latch is received in said slot, and means for connecting a respective needle to each needle carrier.

6. A tufting machine as recited in claim 5, wherein each needle carrier is disposed for reciprocation within at least one guide block secured to and supported by said bracket means.

7. A tufting machine as recited in claim 2, wherein said means for circulating cooling water through said tubing includes refrigeration means.

8. A tufting machine as recited in claim 1, wherein said bar comprises aluminum alloy.

9. A tufting machine as recited in claim 8, wherein said bar and said needles may be selectively shifted laterally, bracket means movable laterally with said needles while permitting said needles to be reciprocated vertically, laterally extending hollow tubing fastened to said bracket means, and means for circulating cooling water through the tubing fastened to said bracket means.

10. A tufting machine as recited in claim 9, wherein said bracket means comprises aluminum alloy.

11. A tufting machine as recited in claim 10, wherein said means for circulating cooling water through said tubing includes refrigeration means.

* * * * *